US006018324A

United States Patent [19]

Kitchener

[11] Patent Number: 6,018,324

[45] Date of Patent: Jan. 25, 2000

[54] OMNI-DIRECTIONAL DIPOLE ANTENNA WITH A SELF BALANCING FEED ARRANGEMENT

[75] Inventor: Dean Kitchener, Brentwood, United Kingdom

[73] Assignee: Northern Telecom Limited, Montreal, Canada

[21] Appl. No.: 08/959,790

[22] Filed: Oct. 29, 1997

[30] Foreign Application Priority Data

Dec. 20, 1996 [GB] United Kingdom ..... 9626550

[51] Int. Cl.[7] ..... H01Q 9/28

[52] U.S. Cl. ..... 343/795; 343/702; 343/793

[58] Field of Search ..... 343/795, 793, 343/820, 821, 822, 702, 700 MS, 846; H01Q 9/28

[56] References Cited

U.S. PATENT DOCUMENTS 3,623,112 11/1971 Rupp et al. ..... 343/821

4,825,220 4/1989 Edward et al. ..... 343/821

5,532,708 7/1996 Krenz et al. ..... 343/821

*Primary Examiner*—Hoanganh Le

*Attorney, Agent, or Firm*—Lee, Mann, Smith, McWilliams, Sweeney & Ohlson

[57] ABSTRACT

The present invention relates to radio communications antennas. A wide band omnidirectional dipole antenna is described comprising a dipole antenna having first and second quarter wavelength dipole arms, a transmission line from input termination point having a ground and a central conductor; wherein the central conductor is connected to a centrally located feed point on the first dipole arm by the transmission line and the second dipole arm is connected to ground and acts as a ground plane for the transmission line. The present invention can be deployed in fixed and mobile wireless terminals and associated therewith. The antenna design can provide a cost effective solution to many applications.

16 Claims, 5 Drawing Sheets

OMNI-DIRECTIONAL DIPOLE ANTENNA WITH A SELF BALANCING FEED ARRANGEMENT

FIELD OF THE INVENTION

The present invention relates to a dipole antenna, and in particular relates to a dipole antenna for fixed and mobile cellular radio communications equipment.

BACKGROUND OF THE INVENTION

Radio communication devices include a radio transmitter and receiver coupled to an antenna which emits and receives radio frequency signals to and from a cellular base station. The devices include a microphone for inputting audio signals to the transmitter and a speaker for outputting signals received by the receiver. The fixed and mobile cellular base stations are situated across the countryside, arranged in cells, with each base station in communication with mobile fixed radios within that area of coverage of that base station.

When a new cellular radio system is initially deployed, operators are often interested in maximising the uplink (mobile to base station) and downlink (base station to mobile station) range. Any increase in range means that fewer cells are required to cover a given geographic area, hence reducing the number of base stations and associated infrastructure costs. The range of the link, either the uplink or the downlink, can be controlled principally in two different ways: by adjusting either the power of the transmitter or the gain at the receiver. On the downlink the most obvious way of increasing the range is to increase the power of the base station transmitter. To balance the link the range of the uplink must also be increased by an equivalent amount.

Power radiating from the handset antennas has tended to increase in order to increase the distances between the handsets and base stations or communications satellites with which the handsets use to link up with public fixed telecommunications networks or other handsets. Ultimately, however, the ranges in many systems are uplink limited due to the relatively low transmitted power levels of hand portable mobile stations and because the output power of a transmitter on a mobile is limited to quite a low level to meet national regulations, which vary on a country to country basis. An efficient omnidirectional antenna can improve the uplink.

Fixed wireless access terminals are increasingly being deployed especially in third world and underdeveloped countries, where there is a limited existing wired telephone network. Wireless terminals enable the telephone network to be rapidly expanded by deploying wireless base stations to provide radio coverage using a fixed cellular concept. This can be much faster and less expensive than laying new cables. Existing cellular standards such as IS-54 and GSM can be used as the air interface protocol, except that features such as handover between cells do not have to be implemented because the terminals are at fixed locations.

A fixed wireless terminal is typically intended to be used indoors, in an identical fashion to a conventional wired terminal. Consequently, a user will place the terminal in a location where it is convenient to use. This can present problems if antennas are mounted on the terminal itself, since the location may not necessarily be in a position where the antenna is best placed for transmission and reception of signals. Indeed, the location may be such that the antennas are in a coverage blackspot. These coverage blackspots occur because, inter alia, signals transmitted from a base station, are required to penetrate the users residence. Transmission losses are incurred in such instances when the signal passes into the building, and this is normally at a minimum when the signal propagates through windows or doors, and greatest when the signal has to pass directly through the building walls and floors. This leads to a non-uniform distribution of the signal level inside the users residence, and this is further aggravated by shadowing effects of internal walls and other obstructions. The coverage blackspot may also be due to other external obstacles such as adjacent buildings and the like. In the event that the user does place the terminal in a blackspot, it is possible to connect a remote antenna to the terminal via a coaxial cable, where the remote antenna is perhaps mounted on a wall or window at a good coverage location in the users residence. As an accessory this antenna is required to be low cost, small in size, and versatile in terms of its mounting. Ideally the antenna should be omnidirectional such that the user is not required to orient the antenna in a particular direction, and it should be vertically polarised in common with the signal transmitted by the base station.

In the case of mobile handsets there is also a requirement for high gain antennas, especially ones which are detachable in view of the increasing concern which has arisen over the proximity of handset aerials to the body in general and the brain in particular. These scares have drawn on research carried out by scientists in Australia, America and Sweden, which has suggested that problems such as senile dementia, cancer and asthma might be associated with the use of mobile handsets. Whilst there are conflicting reports suggesting that the handset, in use, excites RF currents in the body and the body actually forms part of the radiator for the handset, public fears have arisen over the use of such handsets, and in particular, repeated prolonged use. The output of a typical handset can be around 0.6 W maximum, of which the user is exposed to about 0.6 mW—a level well below present safety limits suggested by bodies such as the American National Standards Institute (ANSI).

Presently, a number of manufacturers are producing handsets which have patch antennas mounted internally of the handset casing; whilst this may reduce the amount of radiation directed towards the user by reason of the antenna being situated adjacent to a ground plane (although the ground plane will also parasitically radiate), radiating powers need to be increased in order to compensate for the directionality and because the users hand will tend to attenuate the signals—with unknown long term effects. Applicants have a copending patent application which, inter alia, provides a communications handset with a detachable antenna. Nevertheless, the choice of antennas is not simple.

A further antenna structure is detailed in a European Patent Application, EP 0487053A1 in the name of Andrew Corporation. This antenna consists of two conducting strips with alternating wide and narrow sections. The structure is shown in FIG. 4. The structure is essentially a travelling wave structure that appears as an end fed collinear array of dipoles. The radiation pattern is omnidirectional in the azimuth plane, and this structure is used for low cost cellular base station antenna installations; it is not suitable for handsets. The end of the array is either terminated by putting a load across the two ends, or by shorting the two ends across. Taking one section, the narrow conductor looks very much like a microstrip track with the opposite wide section acting as its ground plane. This track then feeds the wide section above it. Each pair of consecutive sections are approximately one half of a wavelength in length. Consequently, it is found that two consecutive wide sections, one on each conducting strip, are in phase and these radiate such that the peak radiation is perpendicular to the axis of the antenna. However, some radiation occurs from the narrow sections as well. A means of suppressing radiation from the narrow sections has been detailed in U.S. Pat. No. 5,339,089. This amounts to adding side walls on to the wide sections, which adds complexity to the structure and therefore cost.

OBJECT OF THE INVENTION

It is an object of this invention to provide an improved dipole antenna. It is a further object of this invention to provide an improved antenna of compact dimensions.

STATEMENT OF THE INVENTION

In accordance with the invention there is provided a dipole antenna comprising first and second dipole arms and a transmission line extending from an input termination point having a ground and a central conductor; wherein the central conductor is connected by the transmission line to a centrally located feed point on the first dipole arm and the second dipole arm is connected to ground and acts as a ground plane for the transmission line.

The dipole arms are of the order of a quarter wavelength long, for a particular frequency within the band of operation of the antenna. The centrally located feed point is central relative to the two dipole arms; i.e. the feed point is positioned a quarter wavelength from an end of the half wavelength long structure. Typically, the termination point is a coaxial cable termination. The dipole arms can be conveniently formed by metal deposition on a dielectric sheet such as a printed circuit board material. The dipole arms can be printed on opposite sides of a dielectric sheet or may lie on the same side of the dielectric sheet with the transmission line lying on the opposite side, with a via from one side to the other to connect the transmission line structure to the first dipole arm, at the fed point. A preferred dielectric material is FR4, which has a relative dielectric constant of four and is readily obtainable, although the dielectric constant is not produced to a high degree of tolerance.

It is preferable for the dielectric constant to be greater than one: it is possible to have air spacing between thin metallic sheets, with dielectric spacers to maintain the spacing between the plates, but dielectric sheets enable a close spacing between the dipole and transmission line structure; for air-spaced structures, mechanical tolerances may be a problem. Even more preferably, the dielectric constant lies in the range 1–8. Preferably the dielectric sheet material is thin (preferably less than 2 mm).

Preferably, both quarter wavelength dipoles can have a tapered section along adjacent sides. The quarter wavelength dipoles can be arranged in a non overlapping relationship. Alternatively, the quarter wavelength dipoles overlap in the region of the tapered section. The quarter wavelength dipoles can be a quarter wavelength wide. Preferably, the widths of the quarter wavelength dipoles, in micro-strip/printed circuit, are at least six times the width of the transmission line structure, to ensure the correct characteristic impedance for the transmission line.

Preferably, the feed network has a matching network to connect with the transmission line structure. Preferably, the matching network can be a printed section. The matching network can be formed with discrete components.

The current invention can provide a printed half wave dipole which can be produced at a low cost, has no balun, consists of a single part, has an integral feed and matching section, and exhibits broad band performance.

DESCRIPTION OF THE DRAWINGS

In order that the invention may be more fully understood, reference will now be made to the figures as shown in the accompanying drawing sheets, wherein.

DETAILED DESCRIPTION OF THE INVENTION

Figure 1:
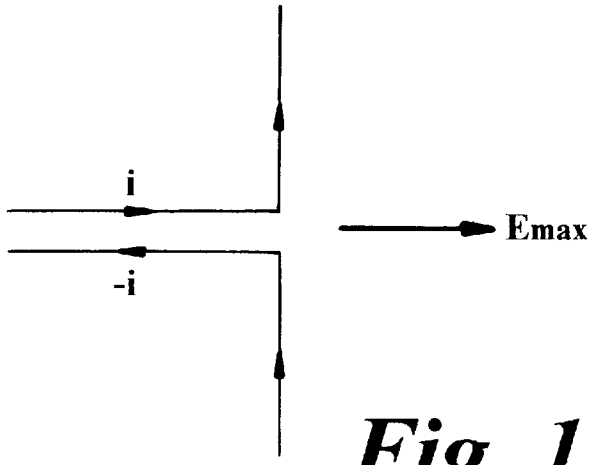
FIG. 1 shows a dual dipole arm antenna.

Half wavelength dipoles are simple antennas, but strictly require a balanced feed arrangement, whereby the currents supplied to the two dipole arms are equal in magnitude but opposite in phase. FIG. 1 shows such an arrangement. This leads to the energy radiated from each arm being in phase, and consequently the peak radiated energy is in a direction perpendicular to the dipole axis. Since the dipole is rotationally symmetric about its axis an omnidirectional radiation pattern results. In the direction of peak radiation the energy is polarised such that it is parallel to the dipole axis.

Figure 2:
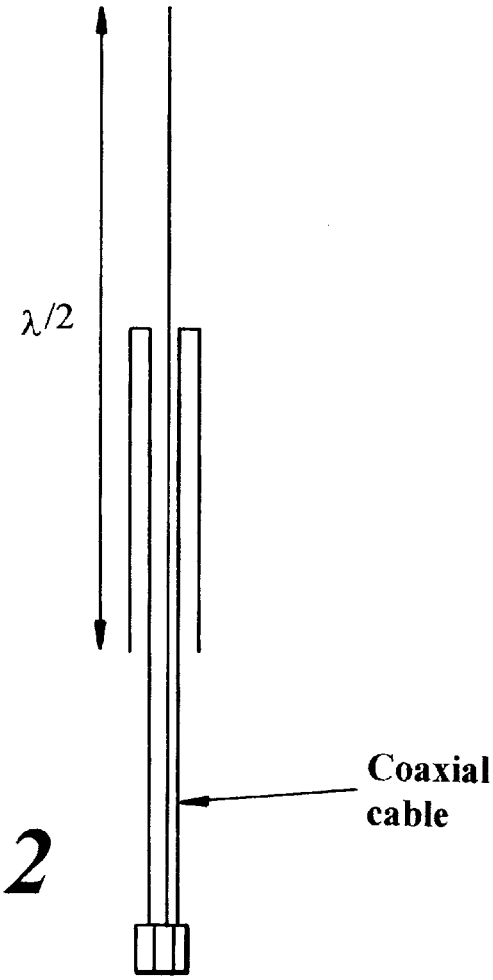
FIG. 2 shows a conventional end feed dipole antenna.

Typical microwave transmission lines are unbalanced, and an example of a common unbalanced microwave transmission line is coaxial cable. A conventional end fed dipole design using coaxial cable is shown in FIG. 2. In this design a coaxial cable lies on the dipole axis. At the centre point of the dipole an outer sleeve is connected to the outer jacket of the cable, forming a quarter wavelength coaxial choke otherwise known as a balun. This choke also doubles as the lower dipole arm. The centre conductor of the cable is extended a quarter of a wavelength beyond the open end of the cable, and this forms the upper arm of the dipole.

There are several disadvantages to the conventional end fed dipole. Firstly, several piece parts are required to construct a practical dipole. This adds cost to the design. Secondly, the cable must be held centrally in the choke, and this is normally done by filling it with dielectric (e.g. PTFE). This has the effect of shortening the balun, and thus can shorten the lower dipole arm. This means that tuning is performed by trimming the upper arm. In addition, a plastic over-moulding is normally required, which needs to be reasonably thick, and this can protect the upper arm of the dipole. This is vulnerable since it consists only of the inner wire of the coaxial cable. Finally, for the balun to be effective the ratio of the outer sleeve diameter to the coaxial cable diameter needs to be reasonably large. This ratio sets the characteristic impedance for the choke balun, and is ideally as high as possible to generate an effective open circuit. Further, if this ratio is too small the antenna will have a very narrow bandwidth.

Figures 3A, 3B:
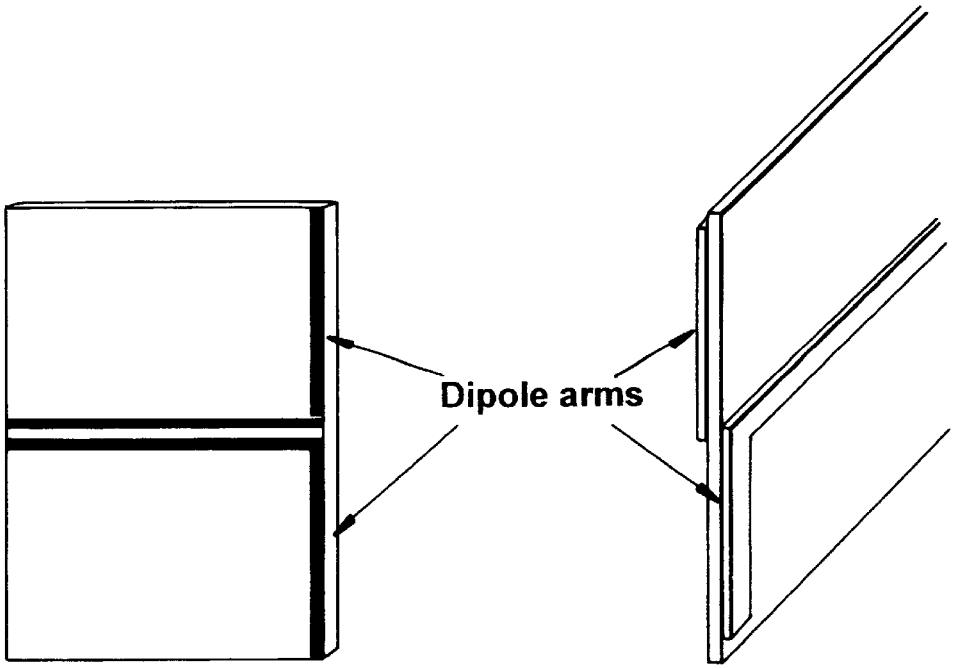
FIGS. 3*a* and 3*b* show two types of printed dipole antennas.
Figure 4:
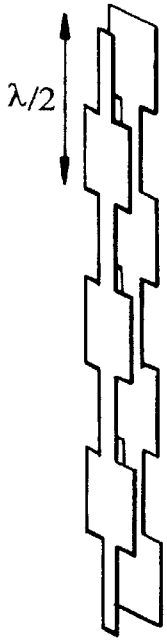
FIG. 4 shows a travelling wave antenna.

Printed dipole antenna structures are also known and two forms are shown in FIG. 3. FIG. 3(*a*) shows the dipole printed on one side of a pcb, with a twin track balanced transmission line feed. FIG. 3(*b*) shows the same design with the transmission line tracks printed on opposite sides of the board. The dielectric substrate for the pcb has a detuning effect on the dipole and so the dipole arms are shortened slightly to compensate. One problem with this design is that the transmission line needs to interface with a coaxial or a microstrip feed, at which point a balun will be required. For a coaxial feed a choke balun could be used, whereas for a microstrip track a printed balun will be required. In both cases the bandwidth of the antenna will be limited by the bandwidth of the balun. A second problem is the fact that the feed line is at 90° to the dipole, and if a vertical dipole is required at some point this line will have to bend downwards. This is then in the plane of the dipole and will result in some perturbations in the azimuth pattern. To minimise this the bend should be a reasonable distance from the dipole, this being typically greater than one quarter of the wavelength. This type of antenna does not lend itself to combination applications such as mobile communications handsets.

Figure 5A:
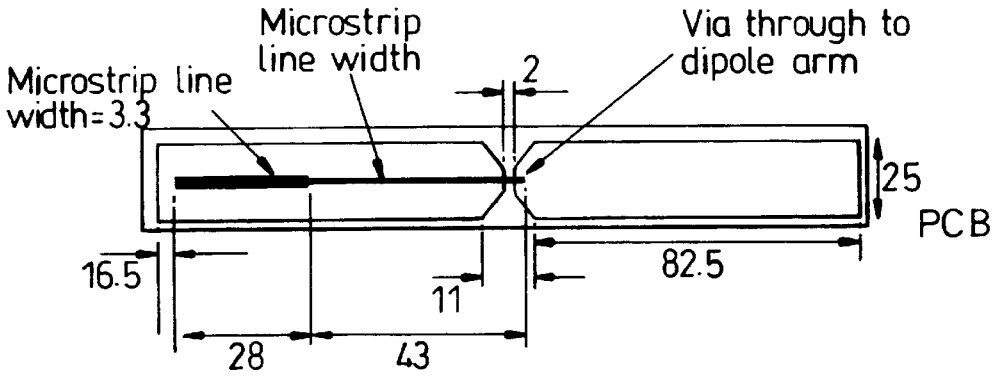
FIGS. 5*a* and 5*b* show a plan view of a first embodiment of the invention.
Figure 5B:
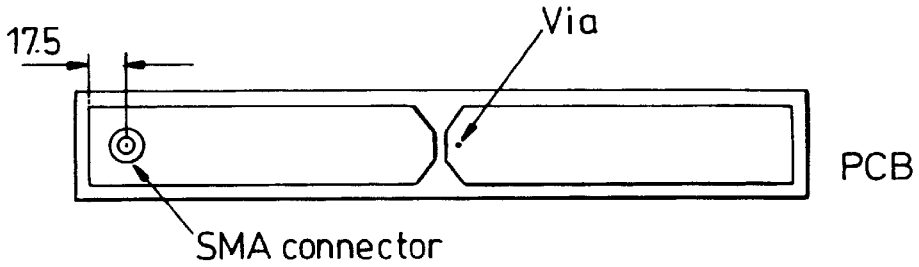

Referring now to FIGS. 5*a* and 5*b*, there is shown a first embodiment of the invention, designed to operate at 860 MHz. The total length of the structure corresponds to a half wavelength version of the structure. The structure is printed on standard printed circuit board, in this case 1.6 mm thick FR4, with a microstrip track on a first surface and the dipole arms on a second surface. The dipole arms could be arranged on separate sides, when there is no need for a via through to the dipole arm. The input connector for connecting to the feed cable is shown in FIG. 5*b* (which shows the first surface of the board) and is positioned at the end of one of the dipole arms, which corresponds to the region of lowest current density for the dipole. This helps to isolate the feed cable from the dipole. A microstrip track is positioned to connect with the dipole feed point (centre of the structure). This can be provided as a 50Ω line at the connector, but beyond this an impedance matching section can be included for optimum power coupling to the antenna.

In a preferred embodiment of the invention the dipole and feed track are printed on opposite sides of a glass fibre printed circuit board material such as FR4, which has a dielectric constant of approximately 4. This relatively high dielectric constant means that the microstrip feed track widths can be kept small, and this helps to minimise any radiation from them. The quarter wavelength dipoles are printed on the dielectric by well-known techniques; the quarter wavelength dipoles are not strictly rectangular but have triangulated sides to improve impedance matching and increase bandwidth.

Another advantage of printing the dipole and its feed track on a single board is that the antenna consists of a single part. This means that assembly or mechanical tolerance issues are reduced, and accordingly manufacturing costs are reduced relative to other, multiband types of antenna. If desired, the antenna can easily be enclosed in a protective plastic cover, but this extra part is common to all other antennas of this type.

Ideally the input impedance for the dipole should be 50Ω since this is the most common impedance used for microwave transmission lines. Thus, a 50Ω coaxial cable is most likely to be connected to the antenna connector, to provide the connection to a user terminal. In practice it has been found that the antenna input impedance is higher than 50Ω and so some impedance matching is required. This need not be a problem as the matching network can be incorporated as an integral part of the structure in the microstrip feed track. In FIG. 5 it can be seen that a quarter wavelength microstrip impedance transformer has been used. Note that the quarter wavelength is not that of free space, but that of the microstrip line which will be shorter than for free space. More complex matching networks can be implemented, microstrip stubs can be used for adding parallel inductance or capacitance; lumped elements can be used if this is more convenient.

Despite the fact that an unbalanced transmission line feed is used for this antenna no balun is required at the feed point. This is because there are only two paths for the current to flow in the feed region, and these paths consist of dipole arms. This is true because the microstrip ground plane and the lower dipole arm are coincident. For cases where the feed line is not an integral part of the structure there is generally a third current path. For a coaxial cable connected directly to the dipoles arms the current from the inner conductor flows along one dipole arm, but the current from the inner surface of the cable outer conductor flows both on the dipole arm and onto the outer surface of the cable. This causes an asymmetric current distribution on the dipole, and the current on the outer surface of the cable radiates resulting in perturbations in the radiation pattern. This is why a choke must be incorporated into the design to prevent current flow along the 'third' path. In the current design there is no 'third' path and the structure is inherently balanced. As has been mentioned previously, no choke is required at the cable connection point for the invention because the connector is at a position of low current density on the dipole, and so no significant current is induced on the outer surface of the cable.

Figure 6:
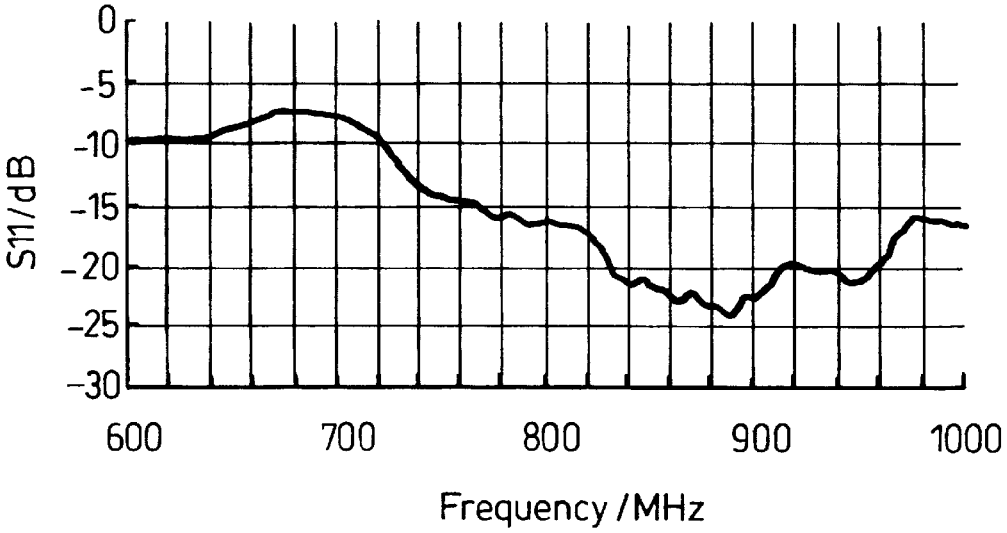
FIG. 6 is a plot of the return loss for the antenna shown in FIG. 5.
Figure 7:
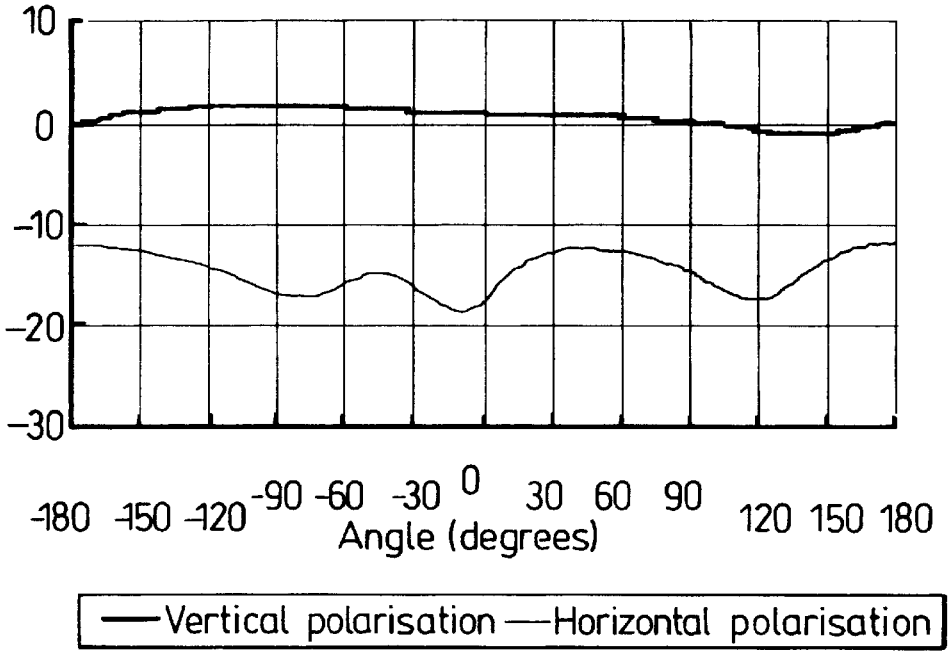
FIG. 7 is a plot of the azimuthal radiation pattern for the antenna shown in FIG. 5.

In FIG. 6 the return loss is shown for the particular embodiment of the invention shown in FIG. 5. This can be seen to have a return loss of >10 dB from approximately 730 MHz to beyond 1 GHz. The azimuth radiation pattern at 860 MHz is then shown in FIG. 7. This is clearly omnidirectional, with a power gain comparable to a half wave dipole.

Figure 8A:
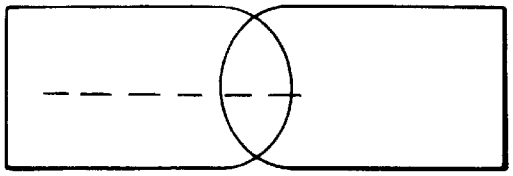
FIGS. 8*a,b* show alternative embodiments.
Figure 8B:
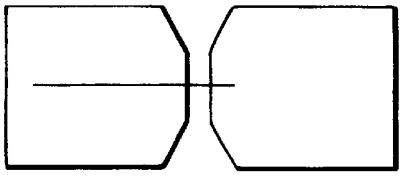
Figure 9:
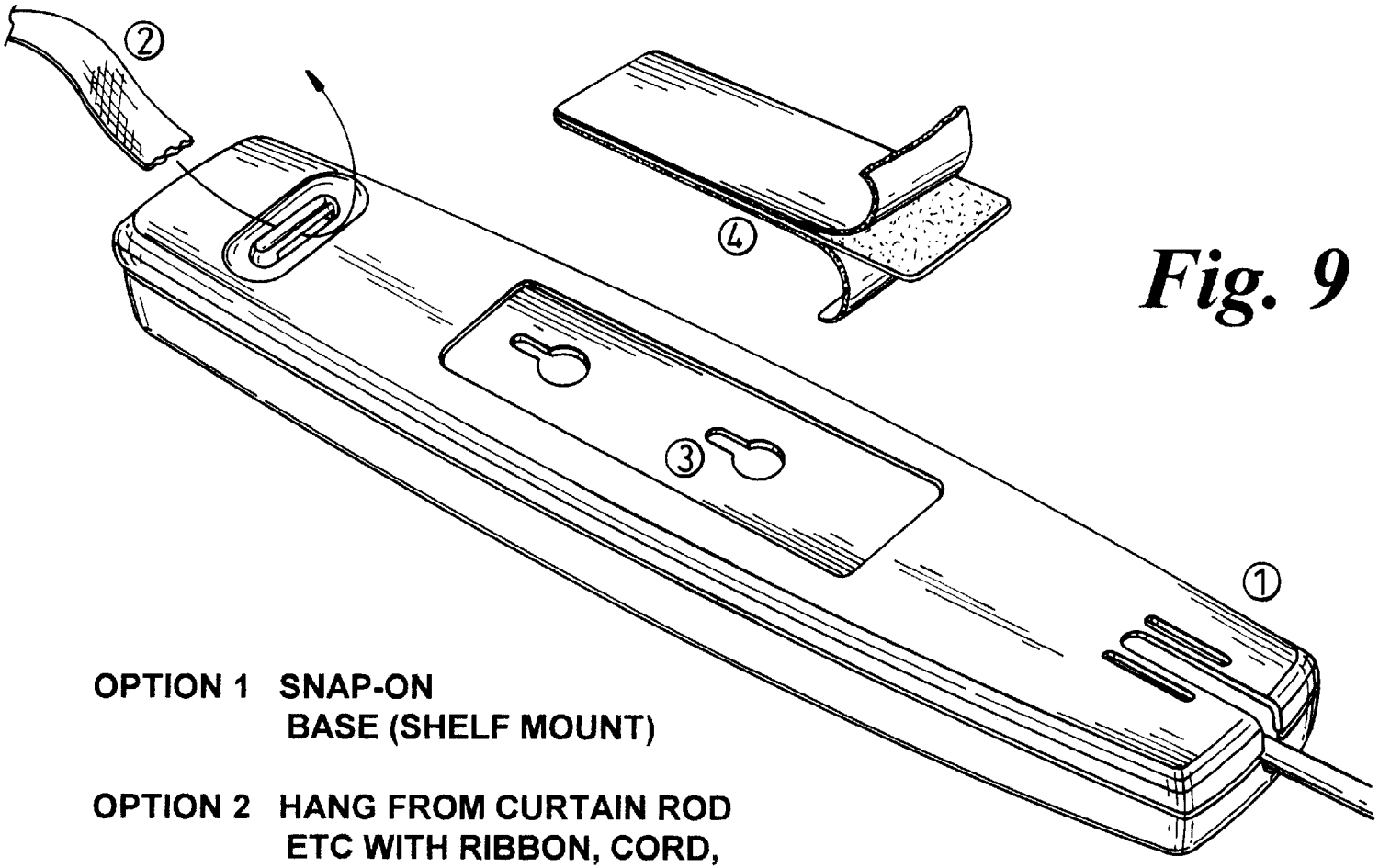
FIG. 9 is shows an enclosure for an antenna made in accordance with the invention.

FIG. 8*a* shows a dipole antenna element made in accordance with the invention wherein the tapered sections overlap. FIG. 8*b* shows an antenna having triangular tapered sections. FIG. 9 details one possible enclosure for an antenna housing to protect the antenna structure and provide a user-friendly means for deployment thereof. The enclosure can be attached to a wall by screw-threaded fastening means, double sided adhesive tape or otherwise, connected to a base and retained by resiliantly biased snap-connection means, or hung from a drape or another structure. Other means of positioning and fastening are possible.

An antenna made in accordance with the invention is thus broadband and provides omnidirectional coverage: such an antenna can be employed with fixed wireless terminals, mobile radio handset terminals with integral antenna and mobile radio handset terminals with detachable antennas.

I claim:

1. An omnidirectional dipole antenna having a self balancing feed arrangement comprising first and second dipole arms, a dielectric substrate and a transmission line extending from an input termination point having a ground and a central conductor;

wherein the central conductor is connected by the transmission line to a feed point on the first dipole arm and only the second dipole arm is connected to the ground and wherein the second dipole arm acts as a ground plane for the transmission line and wherein the transmission line and the second dipole arm are placed on opposite sides of the dielectric substrate.

2. The dipole antenna according to claim 1 wherein the dipole arms are of the order of a quarter wavelength long.

3. The dipole antenna according to claim 1 wherein the termination point is a coaxial cable termination.

4. The dipole antenna according to claim 1 wherein the dipole arms are formed by metal deposition on a dielectric sheet.

5. The dipole antenna according to claim 1 wherein the dipole arms are formed by metal deposition on a printed circuit board material.

6. The dipole antenna according to claim 1 wherein the dipole arms are formed by metal deposition on a dielectric sheet and the dipole arms are printed on opposite sides of the dielectric sheet.

7. The dipole antenna according to claim 1 wherein the dipole arms are formed by metal deposition on a dielectric sheet and the dipole arms are printed on a first side of the dielectric sheet with the transmission line lying on an opposite side, with a via from the first side to the opposite side to connect the transmission line structure to the first dipole arm, at the feed point.

8. The dipole antenna according to claim 1 wherein the dielectric substrate has a high dielectric constant, in the range 1–8.

9. The dipole antenna according to claim 1 wherein the dielectric substrate has thickness of less than 2 mm.

10. The dipole antenna according to claim 1 wherein the antenna dipole arms have a width which is at least six times the width of the transmission line.

11. The dipole antenna according to claim 1 wherein the dipole arms are arranged in a non-overlapping relationship.

12. The dipole antenna according to claim 1 wherein the dipole arms have a tapered section on adjacent sides and overlap in the region of the tapered section.

13. The dipole antenna according to claim 1 wherein the input termination point has a matching network to connect with the transmission line.

14. The dipole antenna according to claim 1 wherein the input termination point has a matching network to connect with the transmission line and the matching network is a printed section.

15. The dipole antenna according to claim 1 wherein the input termination point has a matching network to connect with the transmission line and the matching network is formed with discrete components.

16. The dipole antenna according to claim 1 wherein the dipole arms have a tapered section along adjacent sides.

* * * * *